US005238164A

United States Patent [19]

Freeman

[11] Patent Number: 5,238,164

[45] Date of Patent: Aug. 24, 1993

[54] OFFSET CONVEYOR

[75] Inventor: Ross A. Freeman, Somersworth, N.H.

[73] Assignee: Moore Business Forms, Inc., Grand Island, N.Y.

[21] Appl. No.: 921,208

[22] Filed: Jul. 29, 1992

[51] Int. Cl.[5] ..... B26F 3/02

[52] U.S. Cl. ..... 225/4; 225/100

[58] Field of Search ..... 225/4, 100, 101, 1; 83/94, 89, 86, 85, 29, 105, 106; 271/248, 298, 207, 302, 303

[56] References Cited

U.S. PATENT DOCUMENTS

| | | | |
|---|---|---|---|
| 1,923,458 | 8/1933 | Reilly et al. | 271/86 |
| 2,011,231 | 8/1935 | Olson | 271/52 |
| 2,190,418 | 2/1940 | Davidson et al. | 271/52 |
| 3,052,466 | 9/1962 | Prince | 271/207 X |
| 3,991,924 | 11/1976 | Schueler | 225/100 |
| 4,014,539 | 3/1977 | Goodwin | 271/184 |
| 4,091,978 | 5/1978 | Graham, II | 83/94 X |
| 4,098,458 | 7/1978 | Auchinleck | 271/248 X |
| 5,004,220 | 4/1991 | Dreschel et al. | 271/184 |
| 5,037,081 | 8/1991 | Engelhardt et al. | 271/207 |
| 5,088,721 | 2/1992 | Suzuki et al. | 271/207 X |

*Primary Examiner*—Douglas D. Watts
*Assistant Examiner*—Rinaldi Rada
*Attorney, Agent, or Firm*—Nixon & Vanderhye

[57] ABSTRACT

Continuous business forms are detached and disposed in offset stacks. Continuous forms being fed into a conventional detacher are sensed by a first optical sensor, and after detachment are conveyed by a roller conveyor away from the detacher in a first direction. A guide rail is elongated in generally the first direction and the detached forms have an edge which engages the guide rail so that all the forms in a particular group are aligned when discharged from the conveyor into a stack. The guide rail is mounted on guide rods, for movement in opposite second and third directions, both generally perpendicular to the first direction, so as to change the position of the edge of detached forms in a subsequent group of forms so that consecutive stacks are offset from each other. A second optical sensor at the discharge of the conveyor cooperates with the first sensor and a control mechanism to operate the detacher and solenoids for moving the guide rail between its different guiding positions to form offset stacks of business forms.

23 Claims, 3 Drawing Sheets

Fig. 6
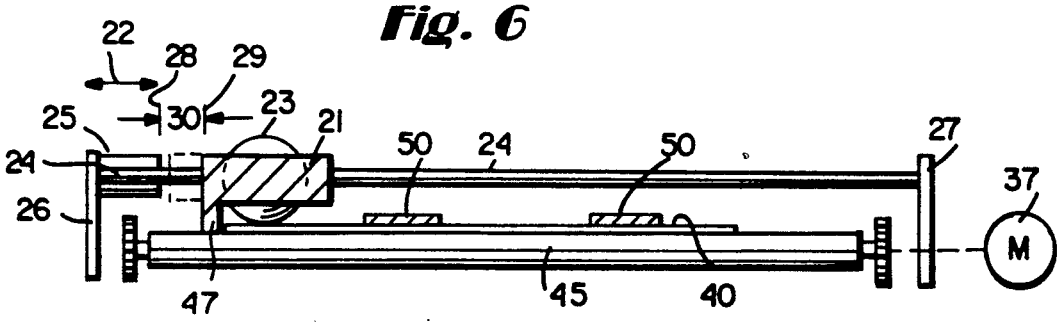
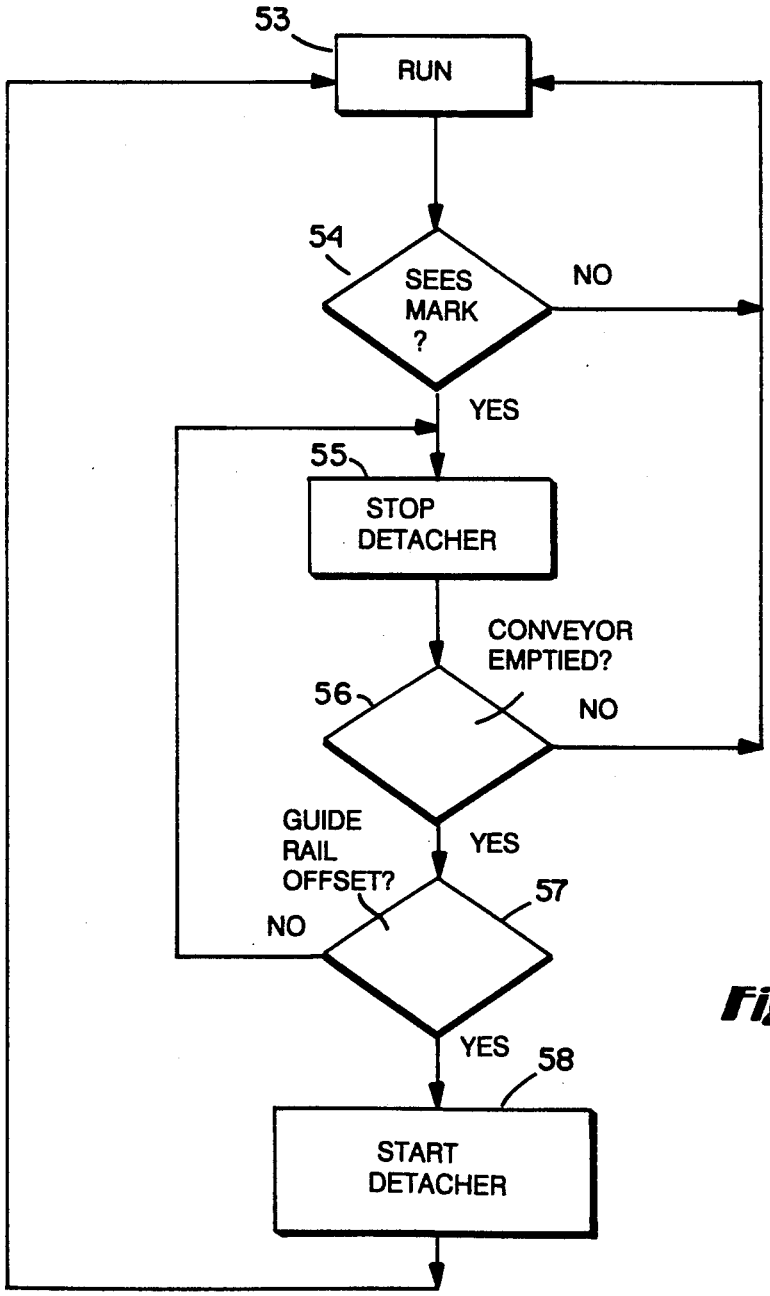
Fig. 7

OFFSET CONVEYOR

BACKGROUND AND SUMMARY OF THE INVENTION

When continuous forms are detached, it is highly desirable to provide some sort of a break between different groups of forms so that the detached forms may readily be handled separately in subsequent operations (e.g. mailing, printing, or other handling). One simple but effective way to accomplish this result is to offset the forms in consecutive groups of forms.

According to the present invention, a method and apparatus are provided for automatically offsetting detached forms of consecutive groups of forms, with respect to each other, for ease of subsequent handling. The method and apparatus according to the present invention are simple and straight-forward, and can accomplish the offsetting in a high speed, effective manner utilizing simple equipment and controls.

According to one aspect of the present invention, a method of producing offset stacks of individual business forms from a feed of continuous business forms using a guide rail elongated generally in a first direction (in which direction the forms are conveyed in) and movable between at least first and second positions in second and third opposite directions, both transverse to the first direction, is provided. The method comprises the following steps: (a) Automatically continuously detaching the forms in a first group of forms, in continuous format, at a detaching position. (b) Automatically conveying the detached forms of the first group away from the detaching position in the first direction guided at one edge thereof by the guide rail, which is in the first position, to form a first stack of forms. (c) Automatically sensing when the last form in the first group has proceeded to the detaching position. Then, (d) automatically arresting step (a) while simultaneously conveying the last detached forms in the first group to the first stack. (e) Automatically sensing when the last form in the first group has been conveyed to the first stack. Then, (f) automatically moving the guide rail to the second position. Then, (g) repeating steps (a)–(e) for all the forms in a second group, to provide a second stack of individual forms offset from the first stack an amount equal to the distance between the guide rail first and second positions.

The method also preferably further comprises repeating step (g) for a further plurality of different groups of forms, each time moving the guide rail in the second or third direction so that its position is changed compared to its position for the previous group of forms. Also, there is preferably the further step of moving the detached forms in the second direction as step (b) is being practiced so as to bias the detached forms into contact with the guide rail. Typically steps (c) and (e) are practiced by optical sensing, as by optically sensing marks on the forms. Also a downward force is typically applied to the forms during the practice of step (b).

According to another aspect of the present invention apparatus for detaching and stacking business forms is provided. The apparatus comprises: A detacher having an infeed and an outfeed. A first forms sensor associated with the detacher. Conveyor means for conveying detached forms from the detacher outfeed away from the detacher in a first horizontal direction, to a discharge. Guide rail means mounted in association with the conveyor means for guiding the edge of a detached form as it is being conveyed by the conveyor means. Means for mounting the guide rail means for movement in horizontal second and third directions, opposite each other and both generally perpendicular to the first direction. Means for automatically moving the guide rail means in the second and third opposite directions. A second forms sensor adjacent the discharge. And, control means connected to the sensors for controlling the detacher and guide rail moving means.

The guide rail means preferably comprises a block elongated in the first direction and having a vertical edge extending upwardly from, or from just above, the conveyor means. The means for mounting the guide rail comprises a plurality of balls mounted in the block and biased to engage the conveyor means, and at least one guide rod (typically two rods) received by bearing means mounted in the block, the guide rod extending in the second and third directions.

The conveyor means may comprise roller conveyors disposed at an angle (e.g. about 5°) so as to bias the forms being conveyed thereby against the guide rail vertical edge. Hold down means, in the form of flexible straps extending substantially the entire length of the conveyor in the first direction (and the balls too), preferably are provided for engaging the tops of forms and keeping them in contact with the conveyor rollers. The guide rail means is typically moved by a pair of solenoids connected to the block and to a frame that is stationary with respect to the conveyor means, and the sensors are typically optical sensors.

According to still another aspect of the present invention, the following apparatus is provided: A detacher having an infeed and an outfeed. Conveyor means for conveying detached forms from the detacher outfeed away from the detacher in a first direction, to a discharge. Guide rail means mounted in association with the conveyor means for guiding the edge of a detached form as it is being conveyed by the conveyor means, the guide rail means comprising a block elongated in the first direction and having a vertical edge extending upwardly from, or from just above, the conveyor means. Means for mounting the guide rail means for movement in second and third directions opposite each other and both generally perpendicular to the first direction, the mounting means comprising a plurality of balls mounted in the block and biased toward engagement with the conveyor means. And, means for moving the guide rail block in the second and third opposite directions.

It is the primary object of the present invention to provide a simple yet effective method and apparatus for offset stacking consecutive groups of detached business forms. This and other objects of the invention will become clear from an inspection of the detailed description of the invention and from the appended claims.

BRIEF DESCRIPTION OF THE DRAWINGS

FIG. 6 is an end view, partly in cross section and partly in elevation, of the apparatus of FIG. 5, looking from the detacher toward the end of the conveyor; and FIG. 7 is a high level flow sheet indicating the basic control procedure for the apparatus of FIG. 1.

DETAILED DESCRIPTION OF THE DRAWINGS

Figure 1:
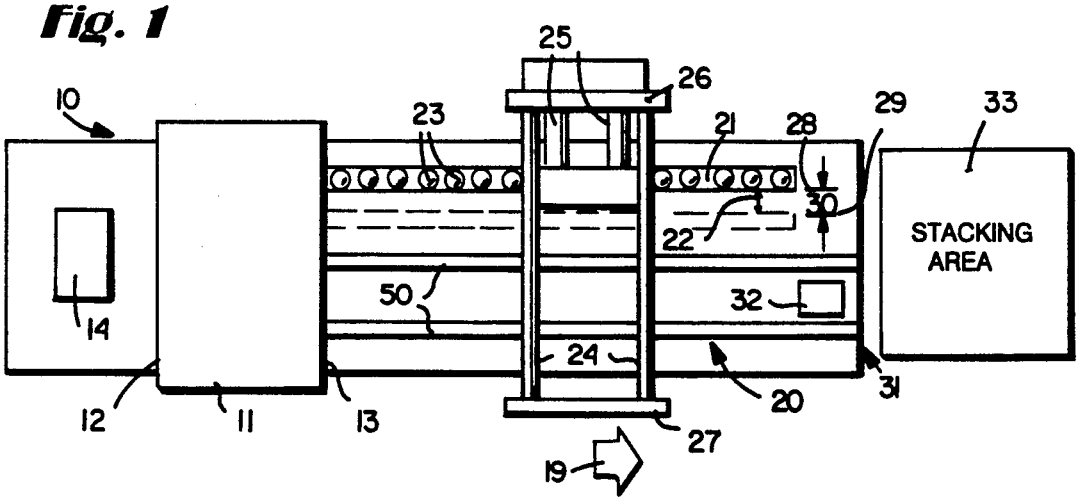
FIG. 1 is a top schematic view of exemplary apparatus according to the present invention.
Figure 3:
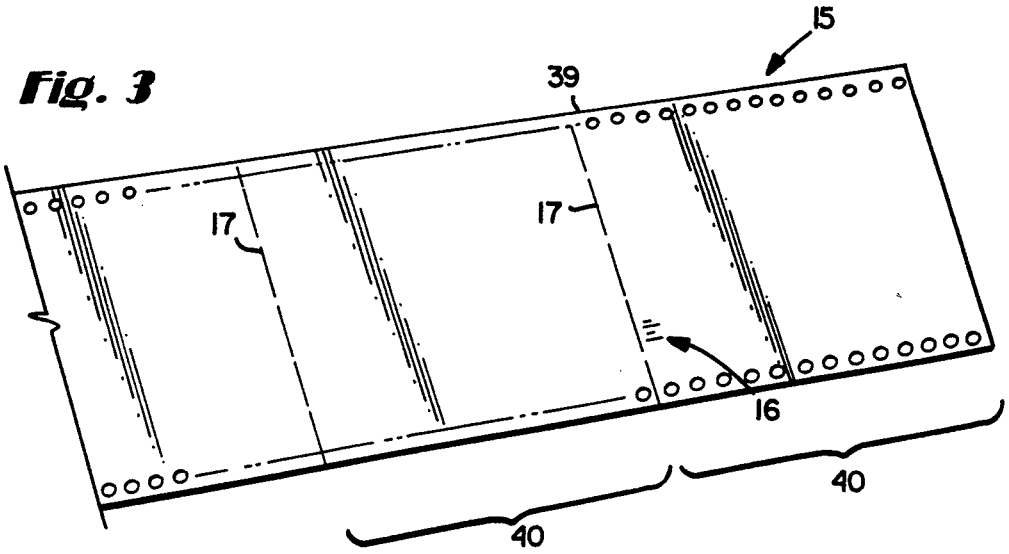
FIG. 3 is a perspective view of an exemplary continuous business form that is fed to the apparatus of FIG. 1.

Exemplary apparatus according to the present invention is shown generally by reference numeral 10 in FIG. 1. The apparatus includes a conventional detacher 11 for business forms, having an infeed 12 and an outfeed 13. Located adjacent the infeed 12 is a first optical sensor 14, which is designed to read marks that have been printed on a continuous business form, such as the exemplary form shown schematically at 15 in FIG. 3. For example the marks 16 are sensed by the first optical sensor 14, the marks 16 being provided as control marks on the first and/or last forms of a group of forms (e.g. all of the same type, that is having the same printing thereon), the continuous individual forms (40) being separated, as is conventional, by perforations 17.

Figure 5:
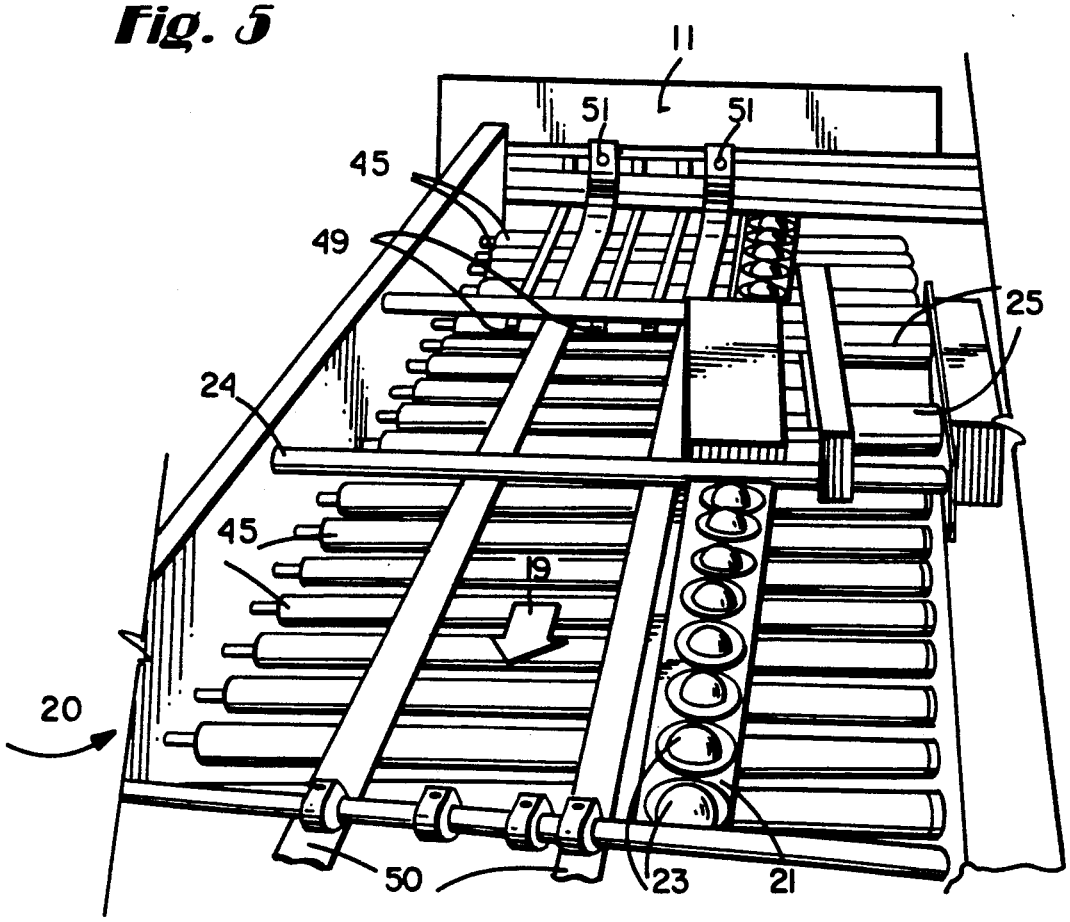
FIG. 5 is a top perspective view looking in from the discharge end of the conveyor illustrating details of the conveyor and guiding components of the apparatus of FIG. 1.

Extending in a first horizontal direction 19 outwardly from the outfeed 13 for the detacher 11 is a conveyor means, shown schematically by reference numeral 20 in FIG. 1, and shown in more detail in FIGS. 5 and 6. Disposed above and in association with the conveyor means 20 is an elongated guide rail means 21, elongated in the direction 19 and movable in horizontal second and third directions that are opposite each other and both generally perpendicular to the direction 19, these horizontal second and third directions being schematically illustrated by reference numeral 22 in FIG. 1. The guide rail means 21 is mounted for movement in the second and third directions 22 by a plurality of balls 23 (as will be hereinafter further described with respect to FIGS. 5 and 6), and at least one, and preferably two, guide rods 24 extending in the directions 22 and parallel to each other. The balls 23 are conventional, and are biased by gravity (and perhaps also by a spring) toward conveyor 20, and will allow a form (40) to pass between them and the conveyor 20 and hold the form on the conveyor 20.

Movement of guide rail 21 in the directions 22 is preferably accomplished by moving means, such as the solenoids 25, mounted at one end thereof to the guide rail 21, and at the other end thereof to a stationary frame surface 26, to which one end of each of the guide rods 24 may also be connected. Another stationary frame component 27 opposite the component 26 is attached to the opposite end of each of the guide rods 24.

Figure 4:
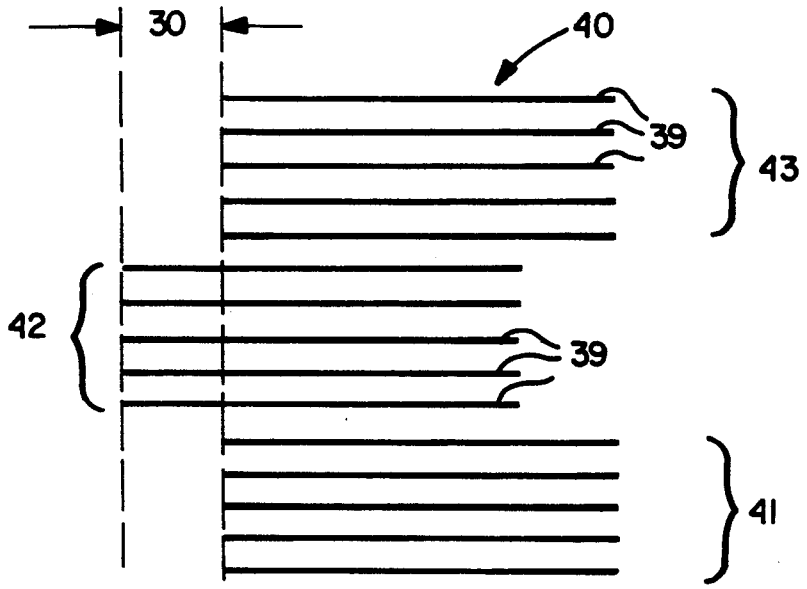
FIG. 4 is a schematic end view showing the formation of offset consecutive stacks utilizing the apparatus of FIG. 1.

The solenoids 25 move the guide rail 21 in the directions 22 at least between first and second positions, shown schematically by reference numerals 28 and 29 in FIG. 1, and spaced apart a distance 30 (see FIG. 6), the distance 30 corresponding to the offset between consecutive groups of forms handled by the apparatus 10 (see FIG. 4). Finally, adjacent the discharge area 31 of the conveyor 20 is a second sensor 32, e.g. an optical sensor. Stacking area 33 is provided adjacent the discharge 31.

Figure 2:
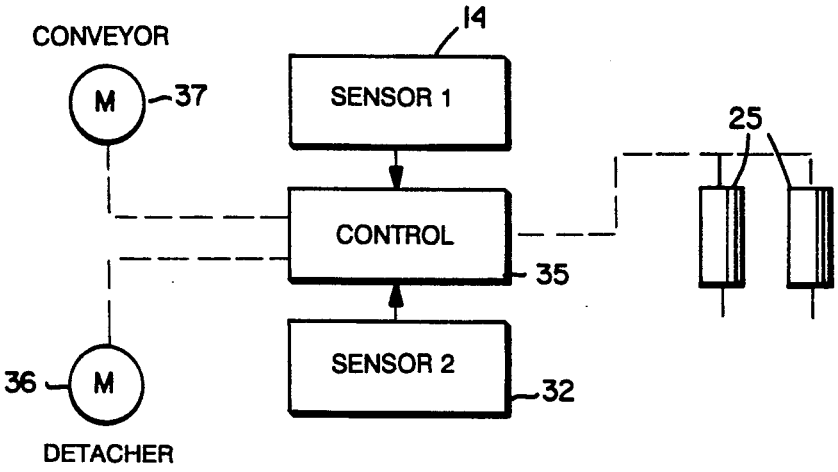
FIG. 2 is a control schematic for the apparatus of FIG. 1.

FIG. 2 is a control schematic illustrating how the various drive components and sensors associated with the apparatus 10 are interconnected. The first and second sensors 14, 32 provide input to a control mechanism 35, such as a computer chip. The control mechanism 35 controls the solenoids 25, as well as a motor or motors 36 which operate the detacher 11, and a motor or motors 37 which operate the conveyor means 20.

The apparatus 10 is controlled by the controller 35 so as to offset the edges of consecutive groups of forms. The continuous form 15 has an edge 39, which also is the edge of each of the individual forms 40 that are formed by the detacher 11 from the continuous form 15, and it is the edge 39 that moves against the guide rail 21. Offset individual stacks, of groups of individual business forms 40, is seen in FIG. 4. Note that the edges 39 of different groups of forms, such as the groups 41 through 43, are offset from each other by the distance 30, that is the distance that the guide rail 21 is moved in the second and third directions 22 between each consecutive form group. The distance 30 is preferably about an inch.

FIGS. 5 and 6 show details of the apparatus 10 of FIG. 1. As seen in both FIGS. 5 and 6, the conveyor means 20 preferably comprises a plurality of rollers 45. The rollers are driven by the motor 37 in any conventional manner, such as a gear drive, belt drive, sprocket drive, etc. The rollers are rotatable about axes that are generally parallel to the directions 22, however it is preferred that they are slightly offset from that direction, e.g. two to seven degrees (preferably about five degrees), so as to cause the individual detached forms 40 discharged from the detacher 11 outfeed 13 to have edges 39 thereof gradually moved against the guide rail 21 as they travel in the direction 19. The offset of conveyor rollers 45 for this purpose is known per se. If the conveyor rollers 45 are offset, the rods 24 are offset that same amount (e.g. five degrees—see FIG. 5) so that the balls 23 move along the rollers 45, or roller 45 existing for each ball 23.

The guide rail means 21 preferably comprises a block of metal or the like (see FIGS. 5 and 6), which has a vertical edge 47 (see FIG. 6) that extends from, or from just above, the uppermost portions of the conveyor rollers 45, so that there is insufficient clearance between the bottom of the vertical edge 47 and the conveyor rollers 45 for a detached form 40 (see FIG. 6) to move under the edge 47. Note that the balls 23 are captured within bearings (not shown) within the block 21, and cannot move out of the block 21 but are capable of limited vertical movement, and provide almost friction free movement in the directions 22 due to the rolling engagement between the hard metal balls 23 and the metal conveyor rolls 45. Inside the block 21 are also bearing surfaces (not shown), conventional per se, for the guide rods 24.

FIGS. 6 illustrates the guide rail 21 in one position in solid line, and in its second position in dotted line. In order to make the actuators 25 (e.g. solenoids) as simple as possible, it is desired that the guide rail 21 only be movable between the positions 28, 29 (see FIGS. 1 and 6), however if it is desired to have stacks offset in a number of different offset configurations, the actuators 25 can be constructed to move the guide rail between a number of different positions in the directions indicated by arrows 22.

If desired, at the outfeed 13 of the detacher 11, for the first few conveyor rollers 45, a plurality of spaced conveyor belts 49 (see FIG. 5) may be provided, just to ensure initial proper feed of each of the individual detached forms 40 in the direction 19 immediately from the discharge 13. Also, hold down means, in the form of two elongated straps 50, preferably are provided. The straps 50 are flexible straps, e.g. plastic, and extend substantially the entire length of the conveyor means 20 from the detacher 11—to which they are attached one end thereof, as indicated by 51 in FIG. 5—all the way to the discharge 31 of the conveyor means 20. As shown in FIG. 6, the straps hold the individual detached forms 40 in positive engagement with the conveyors rollers 45 (as do balls 23).

FIG. 7 is a high level control schematic illustrating how the apparatus 10 is controlled to perform the method of stacking forms according to the invention. Block 53 is a "run" block, indicating that the apparatus 10 is running. Assuming that at decision block 54 a mark 16 indicating the end of a group is detected, the detacher 11 is stopped as indicated at block 55, and the conveyor emptied as indicated by decision block 56, to ensure that all of the forms 40 on the conveyor means 20 downstream of the detacher 11 in the first direction 19 have been moved to the stacking area 33 before provision is made for the next group of forms. Once it is determined that the conveyor 20 has been emptied, decision block 57 determines if movement of the guide rail 21 in the directions 22 has taken place. Assuming that the guide rail 21 has been moved from position 28 to position 29, or vice versa, so that the next group of forms will be offset from the group just stacked in the stacking area 33, the control block 58 indicates that the detacher 11 motor 36 is then started up again. Then the procedure is repeated for the next group of forms.

With respect to FIGS. 1 through 6 in particular, the continuous form 15 passes to the infeed 12 of the detacher 11 and is continually acted upon by the detacher 11 to form individual detached forms 40 which are conveyed by the conveyor means 20 to the stacking area 33. The conveyor rollers 45 bias the left edges 39 of the forms 40 against the guide rail 21 vertical edge 47 so that the left edges of the forms are uniform. Marks 16 are provided on, for example, the last form 40 in a particular group of forms, and the marks 16 are sensed by the first sensor 14. Once the marks 16 are sensed, the detacher 11 is stopped (by control of the motor 36) once the last form in the group has been detached, and the forms 40 remaining on conveyor 20 are conveyed by the conveyor means 20 toward the stacking area 33. The conveyor means 20 operates even though detacher 11 has stopped, and once the last form 40 has passed past the second optical sensor 32, that condition is sensed (that is no form appears under the sensor 32 after a predetermined period of time, or the sensor 32 senses the mark 16 on the last form), which indicates to the controller 35 that the entire stack 41 of a first group of forms has been provided.

The controller 35 then operates the solenoids 25 to move the guide rail 21 the distance 30 to its other position (28 or 29), and then the detacher 11 (by controlling motor 36) is automatically started up again to repeat this sequence. Normally the conveyor means 20 can continuously operate, but if desired the conveyor means 20 may also be controlled to operate in a particular manner, or to stop, depending upon the data provided by the sensors 14, 32. The next stack 42 formed from the next consecutive group of forms 40 is thus offset the distance 30 from the previous stack 41, as illustrated in FIG. 4.

While the invention has been herein shown and described in what is presently conceived to be the most practical and preferred embodiment thereof it will be apparent to those of ordinary skill in the art that many modifications may be made thereof. For example the conveyor means 20 may be entirely different, the sensors 14, 32 may be magnetic or other types of sensors rather than optical sensors, and air cylinders could be used instead of the solenoids 25, etc. Thus the invention is to be accorded the broadest interpretation of the appended claims so as to encompass all equivalent methods and apparatus.

What is claimed is:

1. A method of producing offset stacks of individual business forms from a feed of continuous business forms in a first horizontal direction using a guide rail movable between at least first and second positions in horizontal second and third opposite directions, both transverse to the first direction, comprising the steps of:

(a) automatically continuously detaching the forms in a first group of forms, in continuous format, at a detaching position;

(b) automatically conveying the detached forms of the first group away from the detaching position in the first direction guided at one edge thereof by the guide rail, which is in the first position, to form a first stack of forms;

(c) automatically sensing when the last form in the first group has proceeded to the detaching position; then (d) automatically arresting step (a) while simultaneously conveying the last detached forms in the first group to the first stack;

(e) automatically sensing when the last form in the first group has been conveyed to the first stack; then (f) automatically moving the guide rail to the second position; then (g) repeating steps (a)–(e) for all the forms in a second group, to provide a second stack of individual forms offset from the first stack an amount equal to the distance between the guide rail first and second positions.

2. A method as recited in claim 1 further comprising repeating step (g) for a further plurality of different groups of forms each time moving the guide rail in the second or third direction so that its position is changed compared to its position for the previous group of forms.

3. A method as recited in claim 2 comprising the further step of moving the detached forms in the second direction as step (b) is being practiced so as to bias the detached forms into contact with the guide rail.

4. A method as recited in claim 3 wherein steps (c) and (e) are practiced by optically sensing the forms.

5. A method as recited in claim 4 wherein step (c) is practiced by optically sensing marks on the forms.

6. A method as recited in claim 5 comprising the further step of applying a downward force to the forms during the practice of step (b).

7. A method as recited in claim 1 comprising the further step of moving the detached forms in the second direction as step (b) is being practiced so as to bias the detached forms into contact with the guide rail.

8. A method as recited in claim 1 wherein steps (c) and (e) are practiced by optically sensing the forms.

9. A method as recited in claim 1 wherein step (c) is practiced by optically sensing marks on the forms.

10. A method as recited in claim 1 comprising the further step of applying a downward force to the forms during the practice of step (b).

11. Apparatus for detaching and stacking business forms, comprising:

a detacher having an infeed and an outfeed;

a first forms sensor associated with said detacher;

conveyor means for conveying detached forms from said detacher outfeed away from said detacher in a first direction, to a discharge;

guide rail means mounted in association with said conveyor means for guiding the edge of a detached form as it is being conveyed by said conveyor means;

means for mounting said guide rail means for movement in second and third directions, opposite each other and both generally perpendicular to said first direction;

means for automatically moving said guide rail means in said second and third opposite directions;

a second forms sensor adjacent said discharge; and control means connected to said sensors for controlling said detacher and guide rail moving means; and wherein said guide rail means comprises a block elongated generally in said first direction and having a vertical edge extending from said conveyor means, and wherein said means for mounting said guide rail means for movement in said second and third directions comprises a plurality of balls mounted in said block, and engaging said conveyor means.

12. Apparatus as recited in claim 11 wherein said means for mounting said guide rail means further comprises at least one guide rod received by bearing in said block, said guide rod extending in said second and third directions.

13. Apparatus as recited in claim 12 wherein said conveyor means comprise roller conveyors, disposed at an angle so as to bias forms being conveyed thereby against said guide rail vertical edge, said guide rods being disposed at said same angle, and a roller associated and aligned with each ball.

14. Apparatus as recited in claim 13 further comprising hold down means for holding forms being conveyed by said rollers on said rollers, said hold down means extending substantially the entire length of said conveyor means in said first direction.

15. Apparatus as recited in claim 11 wherein said means for moving said guide rail means comprise solenoid means connected to said block and to a surface stationary with respect to said conveyor means, for moving said guide rail means.

16. Apparatus as recited in claim 11 wherein said first and second sensors are optical sensors.

17. Apparatus for detaching and stacking business forms, comprising:

a detacher having an infeed and an outfeed;

conveyor means for conveying detached forms from said detacher outfeed away from said detacher in a first direction, to a discharge;

guide rail means mounted in association with said conveyor means for guiding the edge of a detached form as it is being conveyed by said conveyor means, said guide rail means comprising a block elongated generally in said first direction and having a vertical edge extending from said conveyor means;

means for mounting said guide rail means for movement in second and third directions opposite each other and both generally perpendicular to said first direction, said mounting means comprising a plurality of balls mounted in said block and engaging said conveyor means; and means for moving said guide rail block in said second and third opposite directions.

18. Apparatus as recited in claim 17 wherein said means for mounting said guide rail means further comprises at least one guide rod received by in said block, said guide rod extending in said second and third directions.

19. Apparatus as recited in claim 17 wherein said conveyor means comprise roller conveyors, disposed at an angle so as to bias forms being conveyed thereby against said guide rail vertical edge, said guide rods being disposed at said same angle, and a roller associated and aligned with each ball.

20. Apparatus as recited in claim 17 wherein said means for moving said guide rail means comprise solenoid means connected to said block and to a surface stationary with respect to said conveyor means, for moving said guide rail means.

21. Apparatus for detaching and stacking business forms, comprising:

a detacher having an infeed and an outfeed;

a first forms optical sensor associated with said detacher;

conveyor means for conveying detached forms from said detacher outfeed away from said detacher in a first direction, to a discharge;

guide rail means mounted in association with said conveyor means for guiding the edge of a detached form as it is being conveyed by said conveyor means;

means for mounting said guide rail means for movement in second and third directions, opposite each other and both generally perpendicular to said first direction;

means for automatically moving said guide rail means in said second and third opposite directions;

a second forms optical sensor adjacent said discharge; and control means connected to said optical sensors for controlling said detacher and guide rail moving means.

22. Apparatus as recited in claim 21 wherein said guide rail means comprises a block elongated generally in said first direction and having a vertical edge extending from, said conveyor means.

23. Apparatus as recited in claim 22 wherein said means for mounting said guide rail means for movement in said second and third directions comprises a plurality of balls mounted in said block, and engaging said conveyor means.

* * * * *